United States Patent [19]

King

[11] Patent Number: 4,616,794

[45] Date of Patent: Oct. 14, 1986

[54] AIR COMB ARRANGEMENT FOR JET DYEING MACHINE

[75] Inventor: Herbert R. King, Spartanburg, S.C.

[73] Assignee: Milliken Research Corporation, Spartanburg, S.C.

[21] Appl. No.: 769,079

[22] Filed: Aug. 26, 1985

Related U.S. Application Data

[62] Division of Ser. No. 658,741, Oct. 9, 1984, Pat. No. 4,584,854.

[51] Int. Cl.[4] ..... F16L 3/10

[52] U.S. Cl. ..... 248/67.5; 248/68.1; 248/316.5; 269/238; 24/514

[58] Field of Search ..... 248/67.5, 68.1, 70, 248/225.31, 231.5, 231.6, 316.1, 316.5, 316.6; 269/238, 287; 24/489, 513, 514

[56] References Cited

U.S. PATENT DOCUMENTS

| | | | |
|---|---|---|---|
| 1,409,233 | 3/1922 | Pataky | 248/231.5 |
| 3,288,409 | 11/1966 | Bethea | 248/231.6 |
| 3,393,411 | 7/1968 | McElveen | 8/151 |
| 3,443,878 | 5/1969 | Weber | 28/163 |
| 3,570,275 | 3/1971 | Weber | 68/205 R |
| 3,942,343 | 3/1976 | Klein | 68/205 R |
| 4,392,366 | 7/1983 | Godfrey | 68/205 R |

*Primary Examiner*—J. Franklin Foss
*Assistant Examiner*—Robert A. Olson
*Attorney, Agent, or Firm*—Earle R. Marden; H. William Petry

[57] ABSTRACT

Apparatus for the application of liquids to moving material, such as patterned application of dyes to moving textile material, including a liquid applicator positioned above the material path of travel for continuously discharging liquid in a row of plural streams downwardly onto the material, means for selectively deflecting selected of the continuously flowing streams in accordance with a pattern control device, and collection means for receiving the deflected liquid to prevent its contact with the moving material. The apparatus includes a novel air comb with air supply tubes in a preselected position relative to its particular dye jet in order to efficiently deflect the dye jet in the proper direction at the proper time.

3 Claims, 9 Drawing Figures

AIR COMB ARRANGEMENT FOR JET DYEING MACHINE

This is a division of application Ser. No. 658,741, filed Oct. 9, 1984 now U.S. Pat. No. 4,584,854 issue date 4-29-86.

The present invention is directed to apparatus for applying liquids to moving materials and, more particularly, to an improved apparatus for the patterned application of dye or other liquids to moving textile materials, such as pile carpets, fabrics and the like.

It is known to apply liquid dyes to moving textile materials from plural streams which are directed onto the materials and selectively controlled to produce a desired pattern thereon. McElveen, U.S. Pat. No. 3,393,411, describes apparatus and process wherein plural streams of dye are selectively controlled in their flow to provide a distinct pattern on a pile carpet.

U.S. Pat. No. 3,443,878 and 3,570,275 describe apparatus and process for the patterned dyeing of a moving textile web wherein continuously flowing streams of dye normally directed in paths to impinge upon the web are selectively deflected from contact with the web in accordance with pattern information. The webs are thus dyed in a desired pattern and the deflected dye is collected and recirculated for use.

In such continuous flow, deflection-type dyeing apparatus, it is known to position a plurality of dye applicators, or "dye gun bars", generally above the path of movement of a material to be dyed and wherein each of the gun bars extends across the path of material movement and is provided with a row of dye outlets which project streams of dye downwardly toward the material to be dyed. Each continuously flowing dye stream is selectively deflected by a stream of air which is discharged, in accordance with pattern information, from an air outlet located adjacent each dye discharge outlet. The air outlet is positioned to direct the air stream into intersecting relation with the dye stream and to deflect the dye into a collection chamber or trough for recirculation. To accurately control the amount of dye applied to a given location on the material during the dyeing operation, and to insure that the dye strikes the material in a very small, precise spot, the lower portion of the collection chamber contains a collector plate supportably positioned in spaced relation above the lower wall of the collection chamber. This collector plate is adjustably attached to the lower wall so that its edge can be accurately positioned relative to the dye discharge axes of the gun bar to insure prompt and precise interception of the streams when deflected. Details of such a dyeing apparatus and collection chamber construction are described and claimed in commonly assigned Klein, U.S. patent application Ser. No. 471,111, filed May 17, 1974, now U.S. Pat. No. 3,942,343.

As described in said application, each dye stream, when deflected, passes across the edge of the collector plate and into the collection chamber. Upon removal of deflection from the stream, the stream moves back across the plate edge and resumes its normal path of travel toward the material to be dyed.

In apparatus of this type to obtain finer definition between colors, it is necessary to use more dye jets per unit measure of the gun bar and consequently, more air tubes per unit length. As the number of air tubes per unit length increases, it is necessary to stagger the location of the air tubes in order to provide the desired number of tubes in a pre-determined length. These tubes must be correctly located with respect to the dye jet and secured in such position so that it will not move during operation of the machine during dyeing of the selected fabric.

Therefore, it is an object of the invention to provide a new and improved air supply tube holder assembly in a jet dyeing machine which insures proper and secure location of the air tube relative to the dye jet.

The invention will be better understood and further explained by reference to the accompanying drawings, in which.

Figure 2:
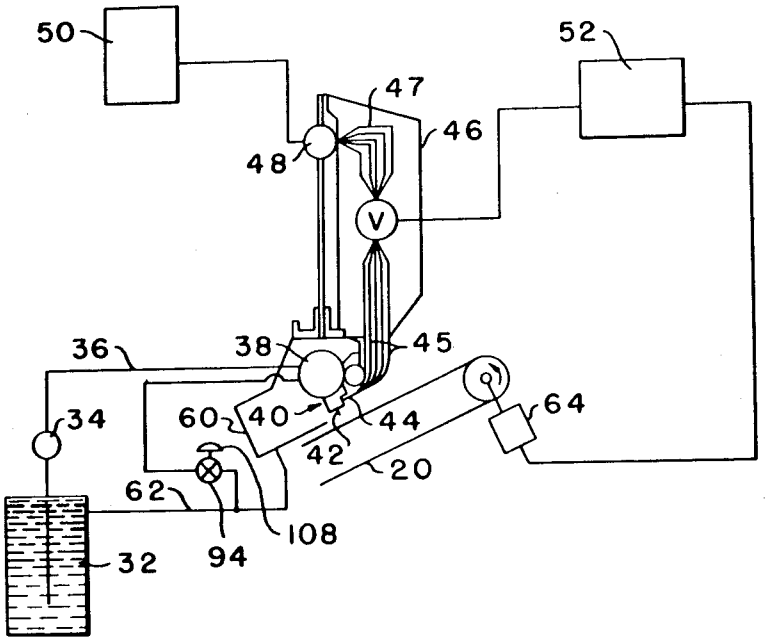
FIG. 2 is a schematic drawing of a single dye applicator or gun bar, of the apparatus of FIG. 1 and shows a basic arrangement for supplying dye to and from, and air under pressure to, each of the gun bars, together with control means for programming the same.
Figure 1:
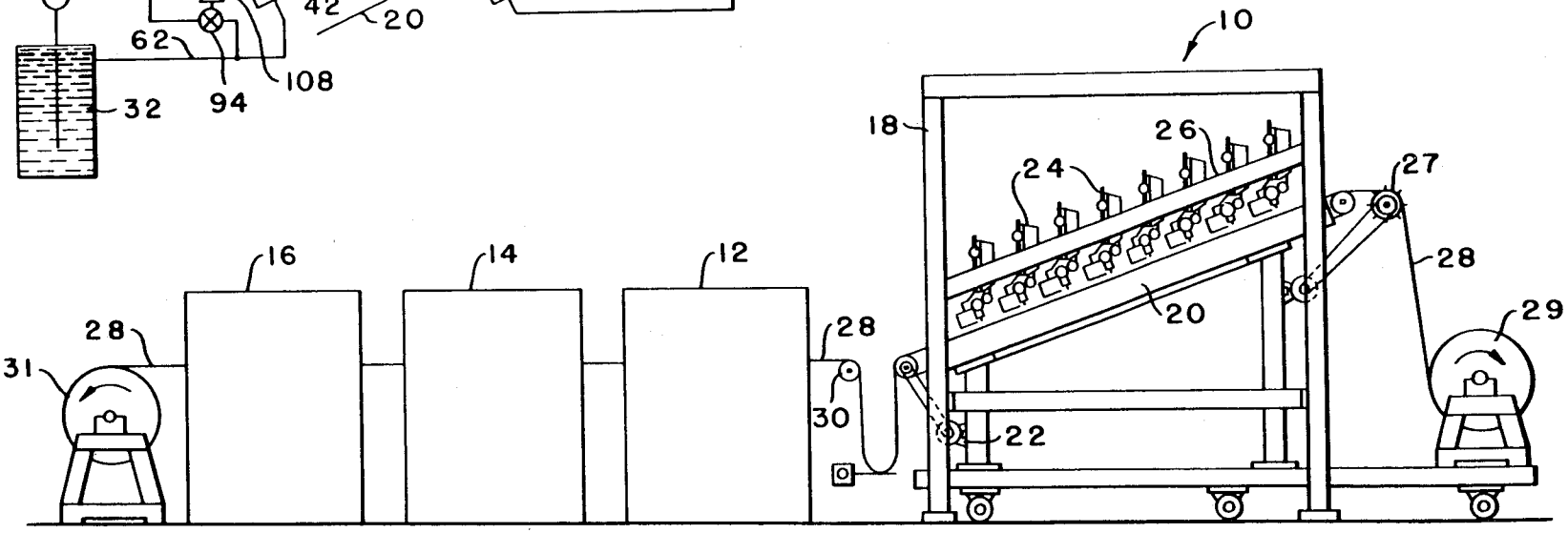
FIG. 1 is a schematic side elevation of apparatus for dyeing a moving material.
Figure 3:
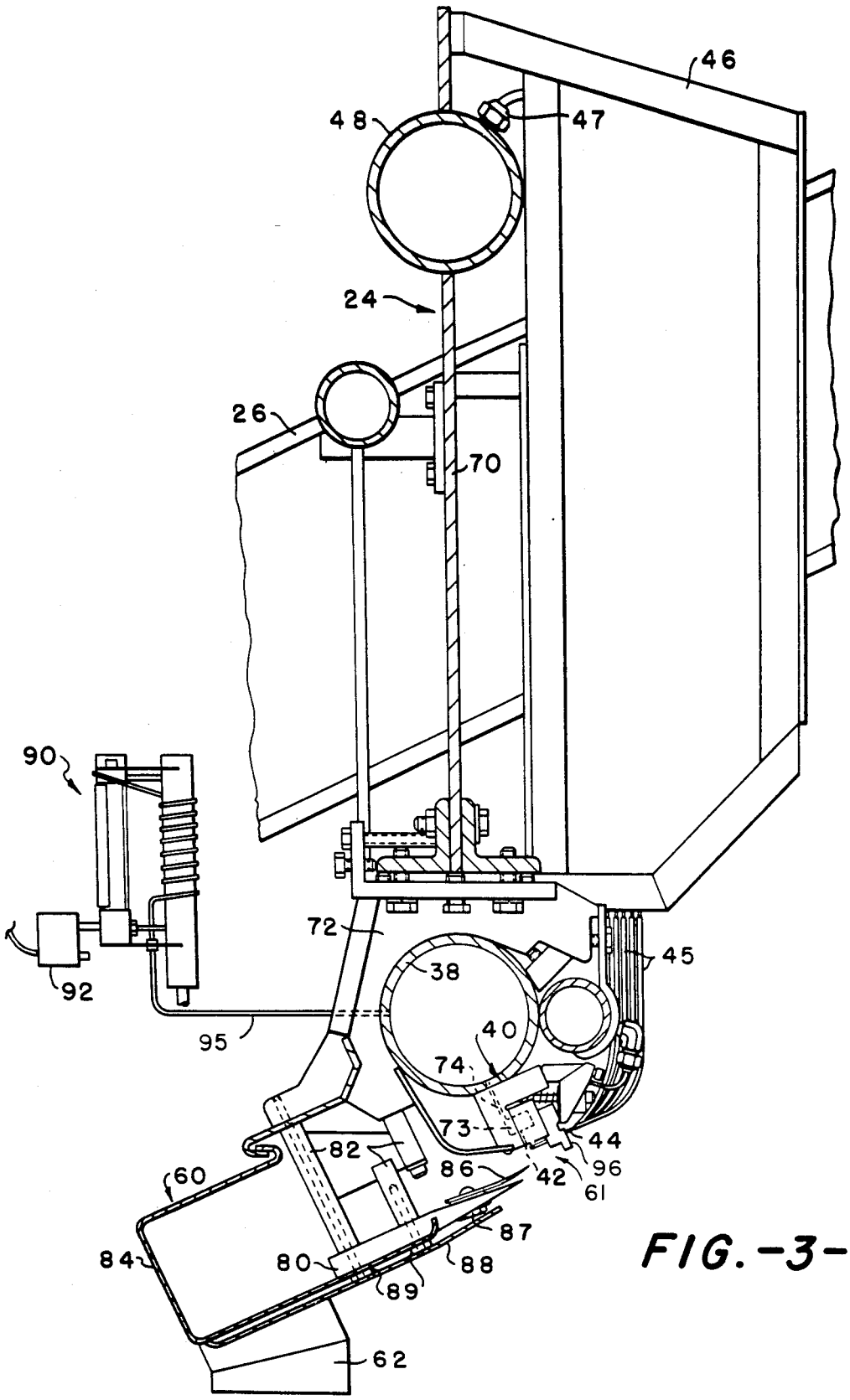

FIG. 3 is an enlarged side view, partially in section, of a gun bar of the apparatus of the present invention, and showing in more detail the positional arrangement of the dye applicator section and dye collection chamber of the gun bar; and FIGS. 4–9 represent air supply tube holder assemblies for the jet dyeing machine of FIGS. 1–3 with the air tube holder assemblies rotated about 60° counter-clockwise for the purposes of illustration.

Figure 4:
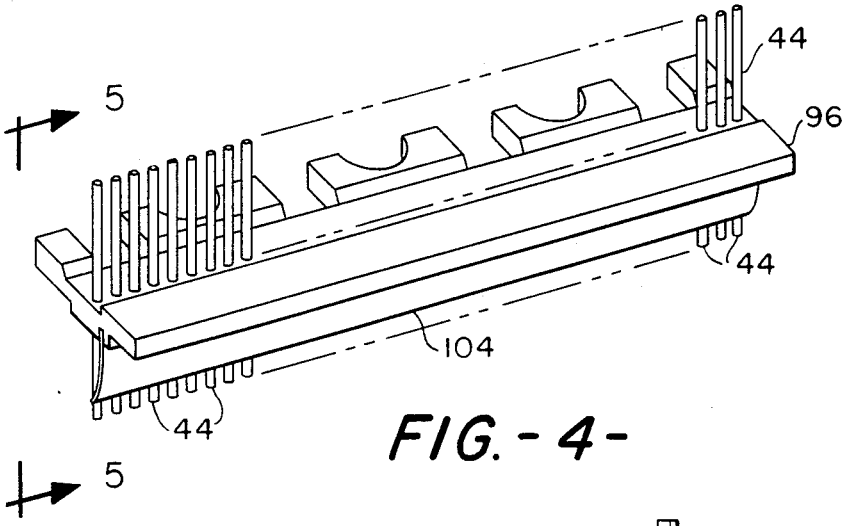
Figure 5:
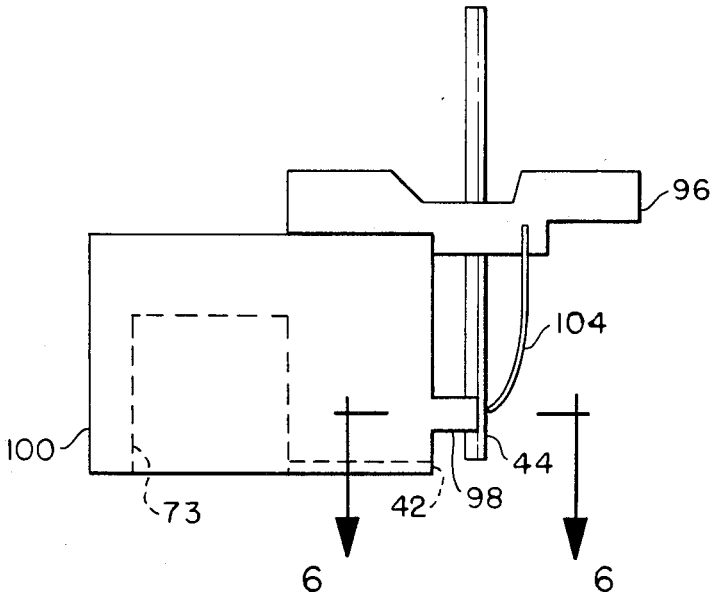
Figure 6:
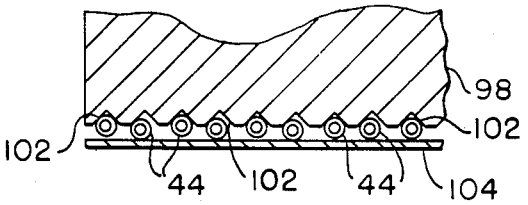

FIG. 4 illustrates the arrangement employed when the air tubes were not staggered;

FIG. 5 is an end view taken on line 5—5 of FIG. 4;

FIG. 6 is a cross-section view taken on line 6—6 of FIG. 5 illustrating the effect when staggered air tubes were employed.

Figure 7:
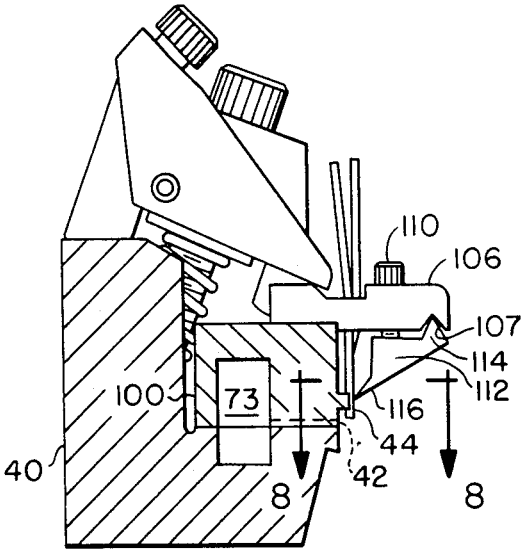
Figure 8:
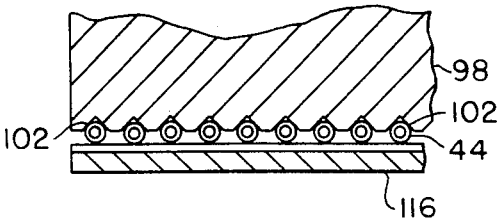

FIG. 7 is a view similar to FIG. 5 illustrating the new and novel air tube arrangement;

FIG. 8 is a cross-section view taken on line 8—8 of FIG. 7; and

Figure 9:
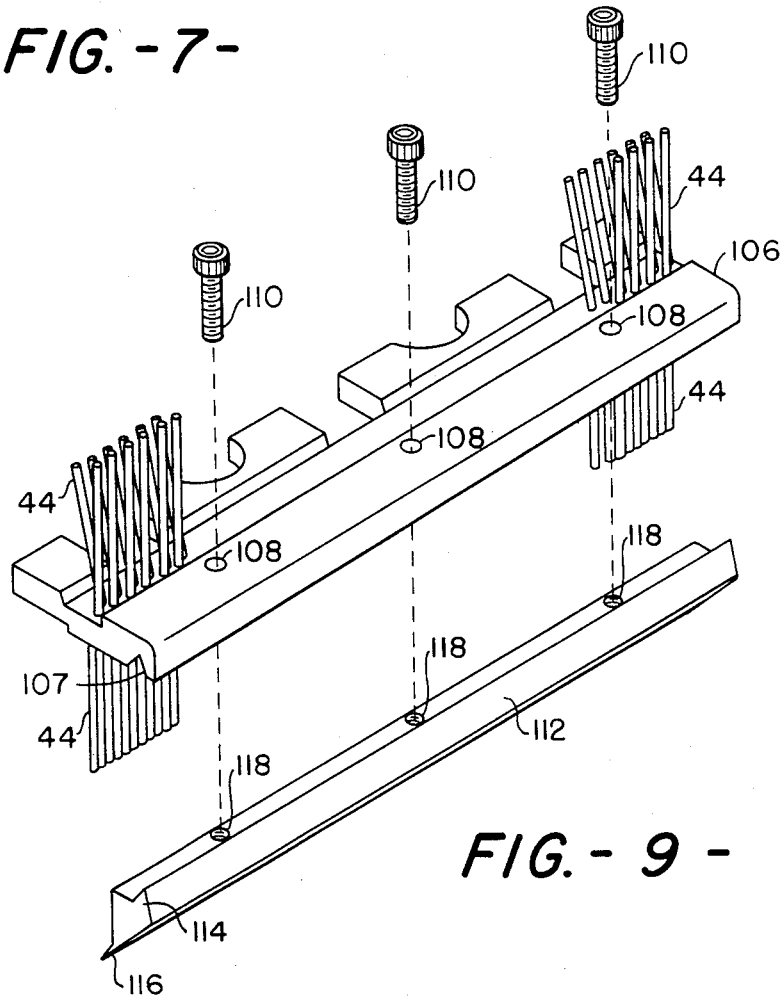

FIG. 9 is an exploded view of the air tube support arrangement of FIG. 7.

Referring more specifically to the drawings, FIG. 1 shows, in schematic side elevation, apparatus for applying liquids to a moving material to which the present invention pertains. As shown and as will be described, the apparatus is particularly adapted for the patterned application of dyes to a moving length of pile carpet material; however, it is to be understood that the liquid applicator of the apparatus could be employed to apply various types of liquids to various moving materials in a programmed manner.

The dyeing apparatus shown generally comprises a dye applicator section 10, a steam chamber 12, a washer 14, and a dryer 16. The dye applicator section 10 is composed of a main frame 18 supporting an inclined conveyor 20 which is driven by motor means 22. Positioned above and spaced along the length of the conveyor are plurality of dye applicator members, or gun bars 24, (8 being shown), which extend in parallel, spaced relation across the width of the conveyor and are suitably supported at their ends by attachment to diagonal frame members (one of which, 26, is shown) on either side of the conveyor. For pattern dyeing broadloom carpets, the conveyor conveniently may be 12 to 15 feet in width and the gun bars 24 each are provided with a different color dye to apply a colored pattern to the carpet.

In operation, a length of carpet 28 is continuously withdrawn from a supply roll 29 by a driven pinroller 27 and delivered to the inclined conveyor 20 which transports the carpet beneath the gun bars 24. Each gun bar is provided with a different colored liquid dye which is dispensed in streams from orifices or outlets spaced along the gun bar onto the carpet as it passes through the applicator section 10. Details of the construction and control of gun bars will be explained hereinafter. Dyed carpet leaving conveyor 20 is directed by suitable support means, such as guide rollers, one of which 30 is shown, through the steam chamber 12, the washer 14, and the dryer 16 where the dyed carpet is treated in conventional manner to fix the dye, remove excess dye, and dry the dyed carpet, respectively. Details of the dye-fixing steam chamber 12, washer 14, and dryer 16 do not form part of the present invention and apparatus for performing such conventional practices are well known in the art. The dyed carpet is collected on a collection roll 31.

The gun bars 24 are of substantially identical construction and the details of their construction and operation can better be described by reference to FIGS. 2 and 3. As seen in FIG. 2, which is a schematic side elevation of a gun bar 24, each gun bar is provided with a separate dye reservoir tank 32 which supplies liquid dye, by means of pump 34 and conduit means 36, under pressure to a dye manifold pipe 38 of the gun bar. Pipe 38 communicates at suitable locations along its length with a sub-manifold section 40 attached to the pipe. The manifold pipe 38 and sub-manifold section 40 extend across the width of the conveyor 20 and sub-manifold section 40 is provided with a plurality of dye outlets 42 spaced along its length to continuously discharge a row of parallel dye streams downwardly toward the material to be dyed.

Positioned adjacent and at about a right angle to each dye outlet 42 of sub-manifold section 40 is an outlet of an air supply tube 44. Each air tube communicates by way of a conduit or tube 45 with a separate valve, illustrated collectively by the symbol V, located in a valve support box 46 of the gun bar. Each valve is, in turn, connected by a conduit or tube 47 to an air supply manifold 48 which is provided with pressurized air by a compressor 50. Each of the valves V, which may be of the electromagnetic solenoid type, are individually controlled by electrical signals from a pattern control device 52. The air outlets of tubes 44 provide streams of air to impinge at approximately right angles against the continuously flowing dye streams from the dye outlets 42 and deflect the same into a collection chamber or trough 60 from which liquid dye is removed, by way of suitable conduit means 62, to dye reservoir tank 32 for recirculation.

The pattern control device 52 for operating the solenoid valves may be composed of various type pattern control means, such as a computer with magnetic tape transport for pattern information storage. Desired pattern information from control device 52 is transmitted to the solenoid valves of each gun bar at appropriate times in response to conveyor movement which is transmitted by suitable transducer means 64 operatively connecting the conveyor 20 and pattern control device 52.

In a typical dyeing operation utilizing the presently disclosed apparatus, when no pattern information is supplied to the air valves of the gun bars from the control device 52, the valves remain "open" to permit passage of pressurized air through supply tubes 44 to continuously deflect all of the continuously flowing dye streams from the gun bar outlets 42 into the collection trough 60 for recirculation. When carpet to be dyed passes beneath the first gun bar of the dye applicator section 10, pattern control device 52 is actuated in suitable manner, such as manually by an operator. Thereafter, signals from transducer 64 release pattern information from device 52 to selectively "close" the air valves so that the corresponding dye streams are not deflected, but pass in their normal discharge paths to strike the carpet. Thus, by operating the solenoid air valves of each gun bar in the desired pattern sequence, a colored pattern of dye is placed on the carpet during its passage through the dye application section 10.

Details of the construction of each gun bar are best shown in FIG. 3 which is an end elevation view, partially in section, of one of the gun bars 24. As seen, each gun bar includes a main structural support plate 70 which extends across the full width of the conveyor and is supportably attached to the diagonal members of the support frame 18. Attached to the upper portion of plate 70 is the air supply manifold 48 and adjustably attached to the lower flanged edge of the plate, by suitable bracket and clamp means 72, which are spaced along the length of plate 70, is the dye manifold pipe 38. Sub-manifold section 40 is suitably attached, as by bolts (not shown), to dye manifold pipe 38 and has a sub-manifold chamber 73 which communicates by way of a plurality of passageways 74 spaced along pipe 38 with an interior chamber of manifold pipe 38 which receive dye therefrom. The dye receiving chamber 73 of sub-manifold section 40 is provided with the plurality of dye discharge outlets 42 which are spaced along the length of sub-manifold section 40 and across the width of the conveyor to discharge dye in a row of parallel streams onto the moving carpet.

Details of the construction and arrangement of the dye collection trough or chamber of the present invention may be best described by reference to FIG. 3. The collection chamber 60 includes a relatively thick, rigid main support plate, or bar 80 which extends the entire length of the gun bar and is attached thereto at spaced locations along the length of the gun bar by rod members 82 connecting plate 80 to the clamping means 72. To provide positional stability for the collection chamber, the support plate 80 is formed of a high strength material, such as a relatively thick stainless steel plate.

The outer walls 84 of the collection chamber are conveniently formed of a thin, lightweight material, such as stainless steel sheet metal, attached in suitable manner to support plate 80 and clamping means 72 of the gun bar (FIG. 3). The outer edge portion of plate 80 is suitably tapered, as shown, to form a sharp edge which extends generally parallel to the row of dye outlets 42 of the gun bar. The support plate 80 also serves as a secondary dye collector, as will be explained.

Supportably positioned in spaced relation above the upper surface of the tapered portion of support plate 80 is a first, or primary dye collector plate 86 which extends the length of the gun bar and has a sharp outer edge positioned closely adjacent and parallel to the row of discharge outlets of the gun bar. The primary collector plate 86 is adjustably attached, as by bolt and spacer means 87, at spaced locations along its length to the upper surface of support plate 80 so that the plate 86 may be moved to position its outer edge relative to the dye dischage axes of the dye outlets. Various fastening means may be employed for adjustably mounting the primary collector plate and one such means is disclosed in previously referred to Klein, U.S. patent application Ser. No. 471,111, filed May 17, 1974, now U.S. Pat. No. 3,942,343.

Supportably attached, as by screw and spacer means 89, in spaced relation below the support plate 80 is a third dye collector plate 88, the outer edge of which extends generally parallel to the outer edge of plate 80 and 86 and is located at a further distance from the discharge axes of the dye outlets of the gun bar than these two edges. In the embodiment shown in FIG. 3, the third collector plate 88 does not communicate directly with the interior of the dye collection chamber, but extends in spaced relation below the collection chamber throughout its length to points beyond both sides of the conveyor so that dye collected by the third collector plate may drain from the open sides of the collector plate without striking the moving carpet being dyed.

As seen, the collection chamber 60 has an elongate opening or entrance 61 for the reception of deflected dye. The opening extends the length of the gun bar and is located on the opposite side of the discharge axes of the dye outlets 42 from the air supply tubes 44. The dye deflected by streams of air from the air supply tubes passes into the opening of the dye collection chamber and flows by gravity into the lower interior portion of the chamber. The collected dye is removed, as by gravity, from the collection chamber through one or more drain lines 62, which direct the dye back to the dye reservoir 38 for recirculation.

In FIG. 3, the reference numeral 90 represents a meter which senses the flow rate of the dye fluid from the dye jets by measuring a head pressure and through the transducer 92 controls the opening and closing of the flow valve 94 (FIG. 2). The flow controller 90 receives dye fluid from the manifold 38 through the inlet connection 95 to operate in the manner disclosed in U.S. Pat. No. 4,392,366.

Looking now to FIGS. 4 and 5, the air tube holder assembly 96 is shown with the air tubes 44 assembled in a single row with their outlets perpendicular to their respective dye discharge outlet 42. To properly locate and maintain the air tubes 44 in correct position and alignment with the dye outlet, the longitudinal rib 98 in the face of the upper portion 100 of the dye ejection module is formed with V-shaped grooves 102 perpendicular to the centerline of the dye discharge outlet 42. The sides of the V-shaped grooves 102 are at 45° angles to the centerline of the dye outlets 42 with the apex aligned with the dye outlet centerline. The air tubes 44 in the air tube holder assembly 96 are maintained in correct position in the grooves 102 by the stainless steel spring strip 104 secured in the air tube holder assembly.

The above described arrangement works well when you are dying fabrics where definition of designs are not critical; but when it is necessary to dye fabric with designs that definition is critical, it is then necessary to provide more dye outlets per unit length and consequently more air tubes per unit length. Due to space limitations, the air tubes 44 were staggered in the air tube holder assembly 96. It was found, as shown in FIG. 6 that the spring strip 104 was not strong enough to seat and maintain all of the air tubes 44 in correct position in the grooves 102 of the rib 98. Due to space limitations and materials, it was not feasible to substitute a stronger spring strip 104.

To alleviate the above problem and secure the staggered air tubes 44 in correct position in the grooves 102, the air tube holder 106 is employed. The air tube holder 106 is similar to the holder 96 except it has a longitudinal V-groove 107 in the bottom thereof and a plurality of clearance openings 108 therein to accomodate socket head capscrews 110. Cooperating with the air tube holder 106 is an elongated triangular shaped clamp bar 112 extending longitudinally of the holder 106 and having a V-shaped projection 114 located in the groove 107 of the holder 106. At the other side of the clamp bar 112 is a triangular shaped projection 116 resting against the air tubes 44 at a point opposite the grooves 102 in the rib 98 of the upper portion 100 of the dye ejection module. To force the air tube 44 into position in the grooves 102 and maintain them there, the screws 110 are tightened in the tapped holes 118 to prevent the projection 114 in the groove 107 to cause the triangular projection 116 to move clockwise against the air tubes 44 to force them into the grooves 102. This positive force forces them into the grooves 102 and maintains them there until the screws 110 are rotated in the opposite direction.

It can be seen that the new and novel positive vise-like air tube holder allows the jet dying of fabrics requiring finer definition of design. The novel air tube holder provides positive location of the air tubes relative to the dye orifices and maintains them in such position until it is desired to replace or remove them. This allows the addition of a plurality of air tubes in a staggered arrangement to produce a finer gauge machine for the purpose of finer definition in the dyed fabric.

Although the preferred embodiment has been described in detail, it is contemplated that changes may be made without departing from the scope or spirit of the invention and it is desired to be limited only by the scope of the claims.

I claim:

1. An apparatus to secure and align a plurality of tubular members, each located in a groove of a holder comprising: an elongated tube holder, a plurality of openings in said holder with the centerline of some of said openings being displaced out of alignment with the centerline of other openings in said holder, tube members located in and projecting through said openings and adapted to abut a groove in an adjacent member, an elongated triangular shaped member pivotally mounted to said tube holder and having one portion thereof abutting the projecting portions of said tube members and means operably associated with said triangular members to pivot said triangular member in said holder into contact with the projecting portions of the tube members.

2. The apparatus of claim 1 wherein said tube holder has an elongated groove in the bottom thereof and said triangular shaped member has a projection thereon engaging said elongated groove.

3. The apparatus of claim 2 wherein said triangular member has a plurality of tapped holes therein, said tube holder has a plurality of holes therein in alignment with the holes in said triangular shaped member and said means including screws projecting through the holes in said air tube holder and screwed in said tapped holes in said triangular shaped member.

* * * * *